United States Patent [19]

Dieleman et al.

[11] Patent Number: 4,706,051

[45] Date of Patent: Nov. 10, 1987

[54] METHOD OF MANUFACTURING A WAVEGUIDE FILTER AND WAVEGUIDE FILTER MANUFACTURED BY MEANS OF THE METHOD

[75] Inventors: Pieter J. Dieleman; Willem Goedbloed; Roelof P. De Jong, all of Eindhoven; Theodorus M. Oosterwijk, Zwolle, all of Netherlands

[73] Assignee: U.S. Philips Corporation, New York, N.Y.

[21] Appl. No.: 940,236

[22] Filed: Dec. 9, 1986

Related U.S. Application Data

[63] Continuation of Ser. No. 628,180, Jul. 6, 1984, abandoned.

[30] Foreign Application Priority Data

Jul. 8, 1983 [NL] Netherlands ..... 8302439

[51] Int. Cl.[4] ..... H01P 1/20; H01P 11/00; B21C 23/18

[52] U.S. Cl. ..... 333/212; 29/464; 29/600; 29/DIG. 4; 315/3.5; 333/239; 72/267

[58] Field of Search ..... 29/600, 464, DIG. 4; 315/3.5, 3.6, 39.51, 39.73, 39.75, 39.77; 333/208, 212, 239; 72/266, 267

[56] References Cited

U.S. PATENT DOCUMENTS

| | | | |
|---|---|---|---|
| 2,161,419 | 6/1939 | Kipperman et al. | 72/267 X |
| 2,669,769 | 2/1954 | Peterson | 72/266 X |
| 2,966,987 | 1/1961 | Kaul | 72/267 X |
| 3,157,847 | 11/1964 | Williams | 333/239 |
| 3,587,008 | 6/1971 | Tsuda | 333/212 |
| 3,737,816 | 6/1973 | Honicke | 333/212 |
| 3,949,327 | 4/1976 | Chapell | 333/239 X |
| 3,952,270 | 4/1976 | Louvel | 333/212 X |
| 4,060,779 | 11/1977 | Atia et al. | 333/212 |
| 4,439,748 | 3/1984 | Dragone | 333/239 |

FOREIGN PATENT DOCUMENTS

| | | | |
|---|---|---|---|
| 2128110 | 4/1984 | United Kingdom | 29/600 |
| 2128111 | 4/1984 | United Kingdom | 29/600 |

*Primary Examiner*—Howard N. Goldberg
*Assistant Examiner*—Ronald S. Wallace
*Attorney, Agent, or Firm*—Robert J. Kraus

[57] ABSTRACT

A waveguide filter (43) comprising a series of resonant cavities (45) separated by walls (47) each formed with an iris opening (49) is assembled from two complementary box-like bodies (25) each having an open side (31) and internal partitions forming portions of the walls (47) between the cavities. Each box-like body is manufactured by impact extrusion using an open-topped box-like die (1) in which a slug of material (5) is placed, and a punch (7) which has smaller dimensions than the die and slots (11) for forming the respective partitions. The punch is driven into the die with a force such that the material of the slug is displaced into the slots in the punch and into the space between the punch and the die.

6 Claims, 6 Drawing Figures

METHOD OF MANUFACTURING A WAVEGUIDE FILTER AND WAVEGUIDE FILTER MANUFACTURED BY MEANS OF THE METHOD

This is a continuation of application Ser. No. 628,180, filed 6 July 1984, now abandoned.

BACKGROUND OF THE INVENTION

The invention relates to a method of manufacturing a waveguide filter comprising two or more resonant cavities which are separated by a wall or walls in which or in each of which an iris opening is formed.

Such a method is known from German Patent Specification 1,264,634. With the known method the filter, which comprises a succession of resonant cavities, is constructed from separate plates. The plates are manufactured from a metal sheet and are subjected to a number of operations. Subsequently the plates are assembled by means of auxiliary members, a plurality of plates constituting the outer walls of the filter, after which the cavities are formed by mounting plates in which a window is formed. Then the plates are interconnected by screwed or welded joints, after which some finishing operations are performed.

It is generally known that stringent requirements are imposed on the accuracy with which a waveguide filter is manufactured. Surface irregularities in the walls of the resonant cavities and dimensional errors may lead to substantial power losses and may degrade the filter operation.

The known method, in which the required surface smoothness and the exact dimensions of the resonant cavities are obtained by subjecting the individual plates to a plurality of operations, followed by a time-consuming assembly process, has the drawback that the manufacturing time is long and the manufacturing costs are high.

SUMMARY OF THE INVENTION

It is an object of the invention to provide a simple and inexpensive method of manufacturing a waveguide filter of the construction described in the opening sentence.

According to the invention there is provided a method of manufacturing a waveguide filter comprising two or more resonant cavities which are separated by a wall or walls in which, or in each of which, an iris opening is formed. The waveguide filter is constructed from two complementary box-like bodies which each have an open side and an internal partition or partitions forming a portion or portions of said wall or walls. The box-like bodies are placed against each other with their open sides facing one another, and each body is manufactured by impact extrusion employing a box-like die in which a slug of material for forming the body is placed. A punch, which has smaller dimensions than the die and has a slot or slots for forming the respective partition or partitions, is driven into the die with a force such that the slug material is forced between the punch and the die and into said slot or slots to fill the slot or slots completely and the space between the punch and the die at least partly.

As already stated, accurate dimensions of the resonant cavities are essential for a correct operation of a waveguide filter. Moreover, the location, shape and dimensions of the wall or walls and iris opening or openings between the cavities are critical. With the method according to the invention a waveguide filter can be constructed from two extruded bodies which are formed by means of a punch and die of very accurate dimensions. It is then particularly important that during the extrusion process the slots in the punch are filled completely with the slug material.

The box-like bodies thus manufactured have a smooth interior, so it is not necessary to subject the inner surfaces to a finishing operation. The partitions formed in the slots are positioned precisely and are given the required dimensions during their formation. The filter is formed by placing the two extruded bodies against each other with their open sides facing one another and with the partitions in one body aligned with the partitions in the other body. The pair or pairs of aligned partitions form a wall or walls having an iris opening or openings and separating the simultaneously formed resonant cavities.

For forming the box-like bodies, slugs of material having both satisfactory electrical properties and satisfactory extrusion properties may be used, preferably, aluminium, aluminium-alloys, copper and zinc.

The method in accordance with the invention is suitable for manufacturing waveguide filters of various dimensions and for various uses. It is thus possible to manufacture band-pass filters, low-pass filters and high-pass filters.

An advantage of the method in accordance with the invention is that it is simple, requires few operations and yields inexpensive and readily reproducible waveguide filters. Moreover, the manufacturing time is short, so that large quantities of filters can be manufactured per unit time.

In a preferred version of the method in accordance with the invention the punch has a continuous flange which remains outside the die, when the punch has been driven into the die and during the impact extrusion the slug material is displaced sufficiently to fill completely the space between the punch and die. This results in any excess slug material being situated on the outside of the extruded bodies, so that this material can be removed by a simple mechanical operation such as milling. This has the advantage that all internal dimensions, including the length, width and height of the box-like bodies are established during the extrusion process.

The bottom of each slot in the punch may have a convex or V-shaped profile such that the slot is deeper at its ends, than at the center. Any impurities on the surface of the slug and any lubricants, such as zinc stereate, will then flow outwardly along the bottom of the slot towards the space between the punch and die. As a result of this, the partition formed in the slot will have a very smooth edge.

The invention also applied to a waveguide filter manufactured by means of the method according to the invention.

BRIEF DESCRIPTION OF THE DRAWING

An example of the method according to the invention will now be described in more detail with reference to the accompanying drawing, in which.

DESCRIPTION OF THE PREFERRED EMBODIMENTS

Figure 1:
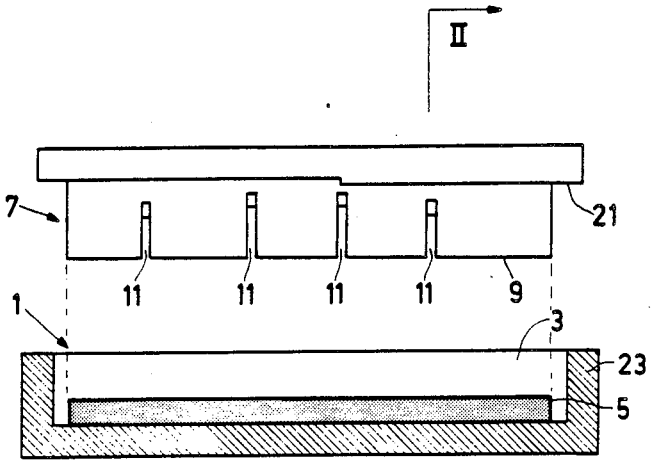
FIG. 1 is a schematic longitudinal sectional view, not to scale, of a die and a side view of a punch which cooperates with the die.
Figure 2:
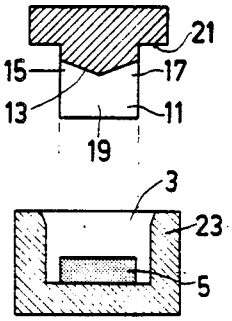
FIG. 2 is a sectional view of the punch and die taken on the line II—II in FIG. 1.

In FIGS. 1 and 2 the reference numeral 1 designates a die. The die 1 comprises an open-topped box-like housing 3 in which a slug 5 of 99.5% A1 is placed. A punch 7 is arranged to cooperate with the die 1, the punch 7 having smaller dimensions than the die so that when the punch has been driven into the die a space exists between the punch and the bottom and side walls of the die. In the side 9 of the punch 7 which faces the die, four slots 11 are formed. The bottom 13 of each slot 11 has a V-shaped or convex profile such that the slot is deeper at its ends 15 and 17 than at the center 19. The punch 7 has a continuous flange 21 which projects over at least part of the upper edge of each of the side walls 23 of the die 1 when the punch is in the die.

In operation the punch 7, in accordance with the known principles of impact extrusion, forms internal partitions 33 in the slots 11. The shape and dimensions of the partitions 33 are identical to those of the slots 11. Consequently, the upper edge 35 of each partition 33 will have a V-shaped or concave profile. In the condition shown in FIGS. 3 and 4 the body 25 still carries the excess slug material around its upper edge, as indicated by the broken line bearing the reference numeral 37. This excess slug material is situated entirely on the outer sides of the side walls 29 of the body 25 and can be removed by a simple mechanical operation, such as milling. If no special requirements are imposed on the outer dimensions of the body 25, the mechanical operation may be dispensed with.

Two extruded bodies 25 are used for constructing a waveguide filter. In the present example of the method in accordance with the invention a waveguide filter includes four half-wavelength resonators which are connected by K inverters each having an inductive iris opening. For this purpose, at one end of each extruded body, a part 40 of the bottom portion 27 and the side walls 29 is removed so that one of the partitions 33 of each body functions as a side wall at one end of the body and the body has only four cavities 39.

The punch exerts a high pressure on the slug 5 in the die 1 such that the yield point of the slug material is exceeded and the material begins to flow, moving upwards into the slots 11 and into the space between the punch 7 and the die 1. The punch 7 is driven into the die 1 with a force such that the material flow does not cease until the slots 11 are filled completely. Due to the V-shaped or convex profile of the bottoms 13 of the slots 11, a flow of material from the center 19 towards the ends 15 and 17 of each slot 11 is obtained, so that any contaminants in the material, for example, contaminants originating from the surface of the slug 5 are moved outwards along the bottom of each slot. The excess slug material flows between the flange 21 of the punch 7 and the side walls 23 of the die 1 towards the outside of the die 3.

Figure 3:
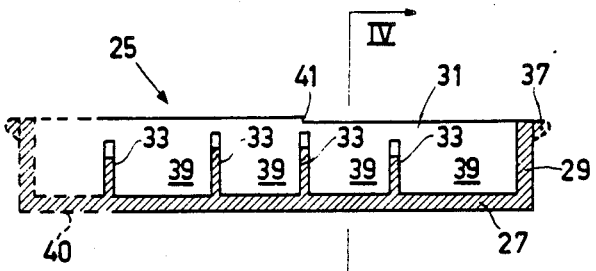
FIG. 3 is a longitudinal sectional view of a box-like body manufactured by impact extrusion with the punch and the die shown in FIGS. 1 and 2.
Figure 4:
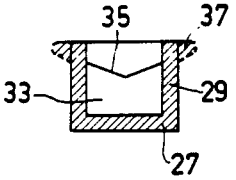
FIG. 4 is a sectional view of the body taken on the line IV—IV in FIG. 3.

FIGS. 3 and 4 show a box-like body 25 which has been manufactured by the method described above. The body 25 comprises a bottom portion 27, side walls 29, and an open upper end 31. The removed part of the body 40 is indicated by the broken line in FIG. 3.

Figure 5:
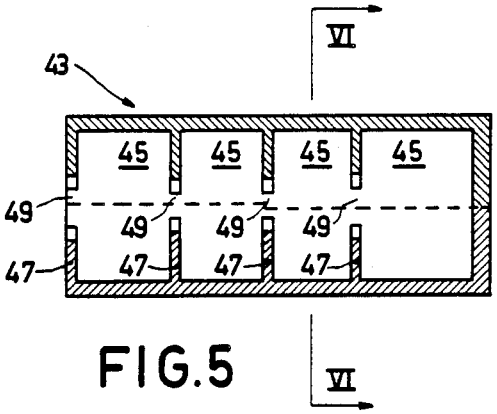
FIG. 5 is a longitudinal sectional view of a waveguide filter constructed from two extruded bodies manufactured with the punch and die shown in FIGS. 1 and 2.
Figure 6:
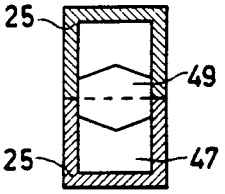
FIG. 6 is a sectional view of the waveguide filter taken on the line VI—VI in FIG. 5.

The waveguide filter in accordance with the invention is manufactured by placing the two bodies 25 against each other with their open ends 31 facing one another, as shown in FIGS. 5 and 6. In order to facilitate positioning of the two bodies 25 relative to each other the edge of each of the two longitudinal side walls 29 of each body is stepped to form a shoulder 41. The waveguide filter 43 thus manufactured comprises four resonant cavities 45 which are separated by walls 47 each formed by two aligned partitions 33 between which an iris opening 49 is formed. The waveguide filter may be provided with an output part.

The method in accordance with the invention can be used in the manufacture of a waveguide filter type having more or less than four resonant cavities. The method is also suitable for manufacturing waveguide filters of a different type, for example filters whose resonant cavities are separated by J-inverters with a capacitive iris opening.

What is claimed is:

1. A waveguide filter having side walls and an apertured separating wall for defining communicating resonant cavities on opposite sides of said separating wall;

said waveguide filter comprising first and second complementary box-shaped bodies each including side walls defining an open side at which the bodies are joined and further including an internal partition extending between opposing ones of the side walls for forming a portion of said apertured separating wall;

each body comprising an impact extruded body having both the internal partition and the side walls thereof formed from a single slug of material which, during extrusion, is forced to fill a space defined between a box-shaped die and a punch inserted into the die.

2. A method for making box-shaped bodies which, when joined, collectively form a waveguide filter including side walls and an apertured separating wall having smooth internal surfaces for defining accurately-dimensioned communicating resonant cavities on opposite sides of said separating wall, said method comprising the steps of:

(a) placing a slug of an impact-extrudable material into a box-shaped die; and (b) forcefully inserting a punch into the die to effect impact extrusion of one of the box-shaped bodies, said die and said punch defining therebetween spaces corresponding to the shape and dimensions of said one box-shaped body.

3. A method as in claim 2 where, during impact extrusion, the slug material is compressed sufficiently to completely fill the space between the punch and the die and to cause any excess slug material to be forced to an outside surface of the extruded body formed.

4. A method as in claim 2 or 3 where the slug material forming the separating wall is directed away from the interior of the box-shaped body by a surface in a slot in the punch for forming the separating wall, said surface defining the slot depth such that it increases with the transverse distance from the center of the slot.

5. A method as in claim 4 where said slot surface is V-shaped.

6. A method as in claim 4 where said slot surface is convex.

* * * * *